United States Patent [19]

Tausevich

[11] Patent Number: 4,641,447

[45] Date of Patent: Feb. 10, 1987

[54] CONCEALED INVENTORY CONTROL DEVICE

[76] Inventor: Edward R. Tausevich, 67 Bramblewood La., Braintree, Mass. 02184

[21] Appl. No.: 706,177

[22] Filed: Feb. 27, 1985

[51] Int. Cl.[4] ..... G09F 19/00

[52] U.S. Cl. ..... 40/530; 312/234; 40/5; 40/312

[58] Field of Search ..... 40/530, 10, 5, 486, 40/312; 312/234

[56] References Cited

U.S. PATENT DOCUMENTS

| | | | |
|---|---|---|---|
| 1,180,750 | 4/1916 | Wolf | 40/10 R |
| 1,569,486 | 1/1926 | Hardin | 312/234 |
| 4,531,311 | 7/1985 | Howard et al. | 40/16 |

*Primary Examiner*—Gene Mancene
*Assistant Examiner*—Wenceslao J. Contreras
*Attorney, Agent, or Firm*—M. Lawrence Oliverio; Jerry Cohen

[57] ABSTRACT

A concealed inventory control device for readily identifying and accounting for objects arranged in sequential front to back and side to side alignment comprising a mechanism for readily identifying the objects arranged from front to back and side to side on a mechanism for supporting the objects, a mechanism for concealing the mechanism for readily identifying, a mechanism for moving the mechanism for readily identifying between a first viewable position and a second non-viewable position, and a mechanism for holding the means for readily identifying in the second non-viewable position.

10 Claims, 8 Drawing Figures

CONCEALED INVENTORY CONTROL DEVICE

FIELD AND BACKGROUND OF THE INVENTION

The present invention relates to devices for identifying and accounting for inventory stored in a retail setting, and specifically to concealed devices. In retail stores in which merchandise is on shelving from the front to the back of the shelf alongside numerous other items of merchandise which is similarly arranged on the same shelf, there is a need to identify and itemize all of the different merchandise stacked alongside each other on such shelving.

Prior methods of identifying merchandise involve permanently affixing an identity tag on the back of a shelf such that when merchandise is stacked in sequence from the back of the shelfup to the front of the shelf, the identity tag is obscured from view until the last item of merchandise in the stack is removed.

Other methods involve placing identity tags on the front edge of a shelf where the tags are always exposed to the view of the consumer and are not desirable by many retailers in this position.

It is an object of the invention to provide an inventory control device which is concealed from view.

It is a further object of the invention to provide an inventory control device which can be readily exposed for viewing.

SUMMARY OF THE INVENTION

In accordance with the invention there is provided a concealed inventory control device for readily identifying and accounting for objects arranged in sequential front to back and side to side alignment comprising: means for readily identifying the objects arranged in front to back and side to side alignment on a means for supporting the objects; means for concealing the means for readily identifying; means for moving the means for readily identifying between a first viewable position and a second non-viewable position; and means for holding the means for readily identifying in the second non-viewable position.

The means for readily identifying preferably comprises a flat strip attached via the means for moving to one of the underside of the means for supporting or a rearward surface of the means for concealing. The means for concealing preferably comprises a lip means extending downwardly from the forward edge of the means for supporting.

The means for moving preferably comprises a joint including a hinge and a means for attaching the joint to the means for readily identifying and the means for supporting or the means for concealing.

The hinge is preferably attached to the means for concealing in substantially parallel arrangement to the forward edge of the means for supporting, with the hinge comprising one of a flexibly resilient material and a pin and aperture means. The means for holding holds the back of the flat strip adjacent to the underside of the means for supporting.

The means for holding preferably comprises one of magnetic means, resilient snap fittable means, resilient snug fittable means, snap action means, adhesive means, spring means, and friction means. The means for readily identifying preferably comprises a plastic strip, and the joint preferably includes the flat strip. The hinge may comprise the means for holding the back of flat strip adjacent the underside of the means for supporting.

The hinge is preferably attached to the back of the lip, with the back of the lip curving rearwardly underneath the means for supporting providing a rearward surface for attachment of the hinge. The plastic strip most preferably includes a crimp conforming the plastic strip to ready movement into a substantially parallel, non-viewable position under the means for supporting.

BRIEF DESCRIPTION OF THE DRAWING

Other objects, features and advantages will be apparent from the following detailed description of preferred embodiments thereof taken in connection with the accompanying drawing.

DETAILED DESCRIPTION OF THE INVENTION

The preferred embodiments of the invention are hereafter described with reference to the drawings.

Figure 1:
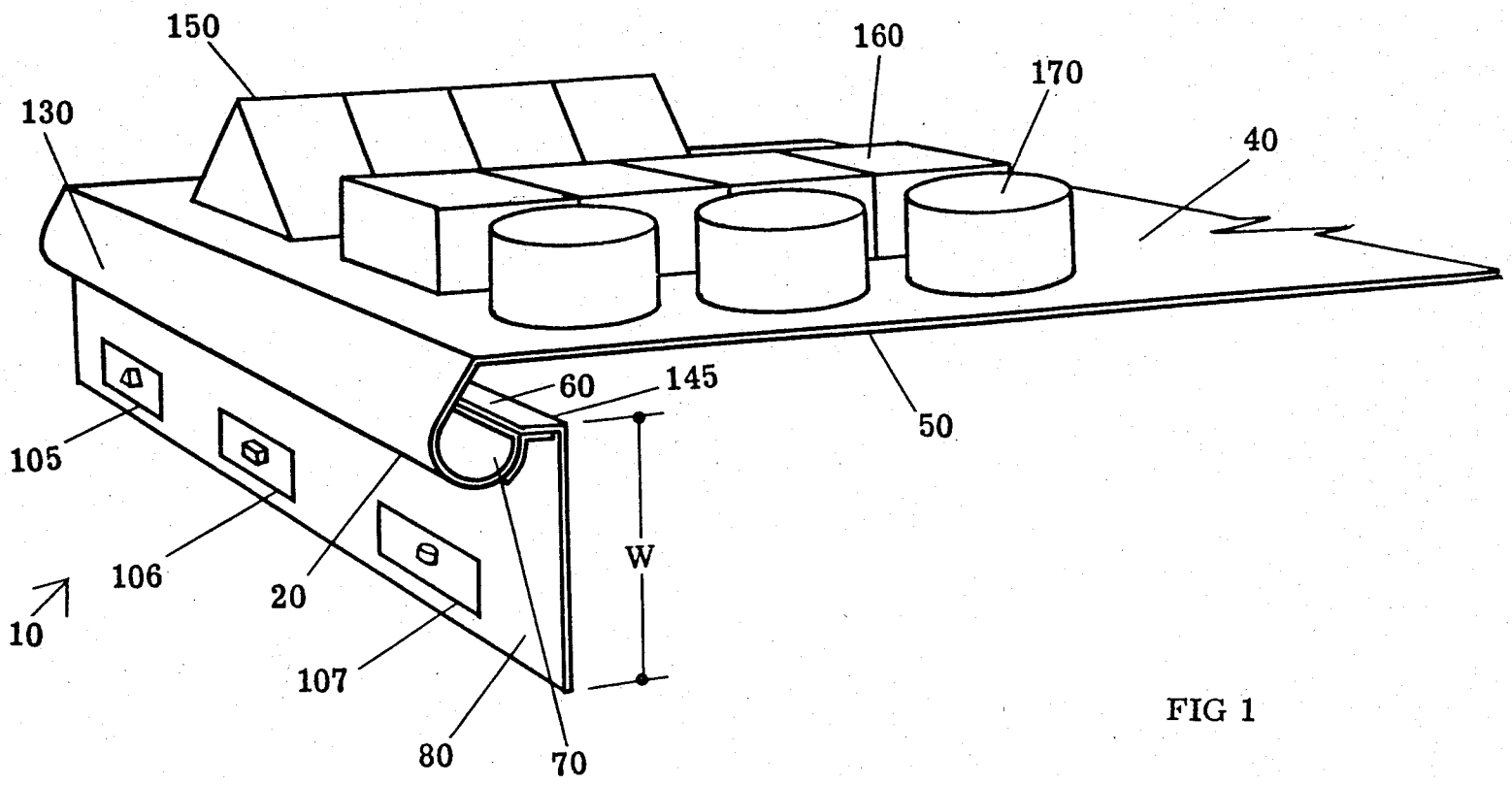
FIG. 1 is an isometric view of a preferred embodiment of a concealed inventory control device according to invention.

FIG. 1 shows a concealed inventory control device 10, including a flat strip 80 which is sitting in the viewable position. Flat strip 80 is made of a sufficient width W as to extend below the bottom edge 20 of lip 130 when placed in the viewable position as shown.

Flat strip 80 and strip 60 preferably comprise a unitary plastic structure having a crimp 145. The back portion 70 of lip 130 protrudes backwardly underneath a shelf 40 providing a backwardly facing surface 90 on which strip 60 is preferably mounted or attached by conventional hinge means 140, 149. The attachment of strip 60 to surface 90 supports flat strip 80, strip 60 and hinge 140 in the position shown in FIGS. 1, 2 whereby the front face of strip 80 is in a viewable position.

Figure 3:
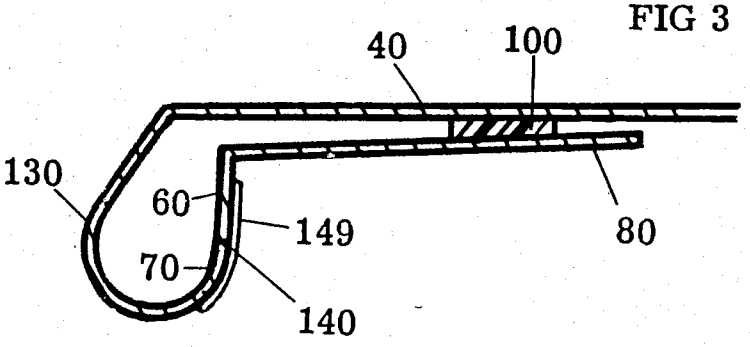
FIG. 3 is a cross-sectional view of the concealed inventory control device of FIG. 1 showing the device in the concealed position; and, FIGS. 4A–4E are cross-sectional views of a variety of shelf/lip configurations preferred for use in constructing a concealed inventory control device according to the invention.
Figure 2:
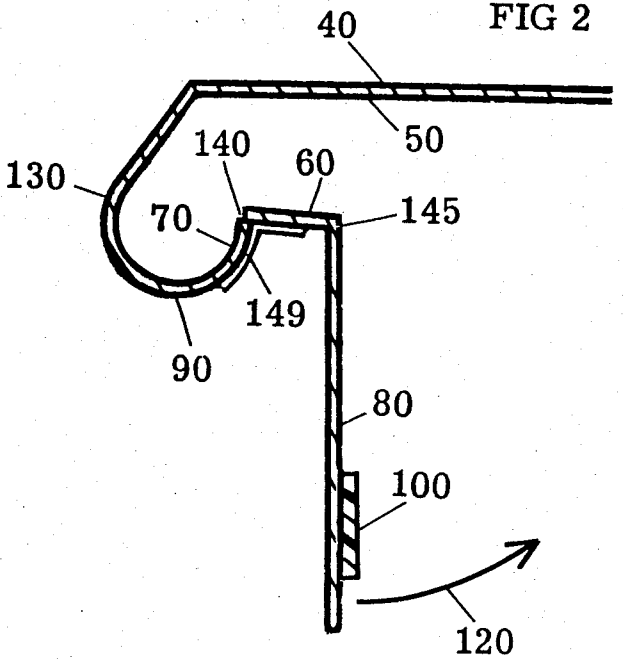
FIG. 2 is a cross-sectional view of the concealed inventory control device of FIG. 1 showing the device in the viewable position.

In the embodiment shown in FIGS. 1–3, strips 60 and 80 comprise a unitary structure of preferably plastic material, such as polypropylene, which is hinged to the back 70 of lip 130 at hinge 140.

The configuration of lip 130 shown in FIGS. 1–3 whereby a backwardly protruding portion 70 is provided, is preferred because it enables ready construction and attachment of a unitary resilient structure, such as the combination of strips 60, 80 and hinge 140, whereby the viewable structure 80 may be moved from a viewable position such as shown in FIGS. 1, 2, to a non-viewable, concealed position which is substantially parallel to the shelf 40 as shown in FIG. 3. The crimp 145 provided in the unitary structure comprising strips 60, 80 allows for the ready construction of such a unitary structure 60, 80 which can be readily attached to the back 70 of lip 130 and conforms such a unitary structure to movement into a substantially parallel, non viewable position under shelf 40, as shown in FIG. 3.

Movement of strip 80 into a concealed position which is substantially parallel to shelf 40 is preferable in order to allow for ready and reliable attachment of strip 80 to the underside 50, FIGS. 1, 3 of shelf 40. Hinge 140 may alternatively be attached directly to the underside of shelf 40 and strip 80 behind lip 130, and such attachment may also allow for movement of strip 80 into and out of positions similar to those demonstrated in FIGS. 2 and 3 whereby strip 80 is either substantially parallel to shelf 40 or viewable.

The angular configuration of crimp 145 will vary depending upon the precise geometrical configuration of the means for concealing 130, the rearwardly projecting surface 90, the point of attachment of the means for readily identifying 60, 80, FIGS. 1–3, (e.g. rearward surface 90 or underside surface 50 or at the angular junction of lip 130 and shelf 40), and the like. Typically the angle of the crimp is about a right angle.

As shown in FIG. 1, shelf 40 supports a plurality of inventory objects 150, 160, 170 in front to back and side to side relationship. Shelf 40 includes lip 130 which extends downwardly below a horizontal plane in which shelf 40 typically lies, such that when strip 80 is rotated backwards in the direction of arrow 120, FIG. 2, and up against the underside 50 of shelf 40, the flat strip 80 is concealed from view.

Strip 80, FIG. 1, includes identity tags 105, 106, 107 spaced apart along the length of strip 80 a distance compatible with the side to side spacing apart of inventory objects 150, 160, 170 on shelf 40. Identity tags 105, 106, 107 may be slidably movable in the conventional manner along the length of strip 80.

The line of hinge 140, FIGS. 1–3 is typically attached (to surface 90, the underside 50 of shelf 40, or in some other manner) such that it is substantially parallel to the forward edge of shelf 40 and/or the bottom edge 20 of lip 130. The combination of strip 60, hinge 140 and strip 80 may comprise a unitary structure having a flexibly resilient hinge line which can withstand repeated curving and distortion. Certain thermoplastic materials such as polypropylene are particularly suitable for such unitary construction whereby the hinge line of hinge 140 is constructed of a much smaller thickness than the remainder of such unitary structure.

Flat strip 80 is typically provided with a magnetic means 100 attached to the backside of strip 80 such that when strip 80 is rotated in the direction of arrow 120, FIG. 2, up against the underside 50 of shelf 40, magnet 100 may attach to a complementary magnetically attractive structure, such as shelf 40 itself, or other means provided at a complementary position on the underside of shelf 40. When magnet 100 attaches to the underside 50 of shelf 40, strip 80 is held in a nonviewable position and concealed by virtue of lip 130.

Hinge line 140, FIGS. 1–3, may itself be provided with a means for holding strip 80 in the concealed position shown in FIG. 3. A snap open, snap closed sort of structure, such as disclosed in U.S. Pat. No. Re. 30,861 issued Mar. 20, 1973 to Krawagna; U.S. Pat. No. 3,289,877, issued Dec. 6, 1966 to Wolf; U.S. Pat. No. 3,292,223, issued Dec. 20, 1966 to Esposito; and/or U.S. Pat. No. 3,720,979, issued Mar. 20, 1973 to Krawagna, the disclosures of all of which are incorporated herein by reference, may be incorporated into hinge 140 as part of a unitary structure. As shown in FIGS. 1–3, hinge 140 includes an adhesive strip means 149 which attaches strip portion 60 to the back surface 90 of lip 130. Such adjesive means 149 can withstand repeated curving and deformation and typically comprises a plastic, nylon filament tape or other conventional organic adhesive.

The back of strip 80 and the underside 50 of shelf 40 may be provided with a variety of holding means for maintaining flat strip 80 in the concealed position. Such holding means typically comprise conventional snap fittable devices, resilient snug fittable devices and adhesive means. The hinge 140 itself may comprise a frictionally tight pin-hole hinge structure which is capable of resisting the downward force of the weight of strip 80 when rotated into the concealed position.

With reference to FIGS. 4A, 4B, 4C, 4D and 4E, there are shown a variety of alternative shelf/lip configurations suitable and preferred for use in constructing concealed inventory devices according to the invention.

Figures 4A, 4B, 4C, 4D, 4E:
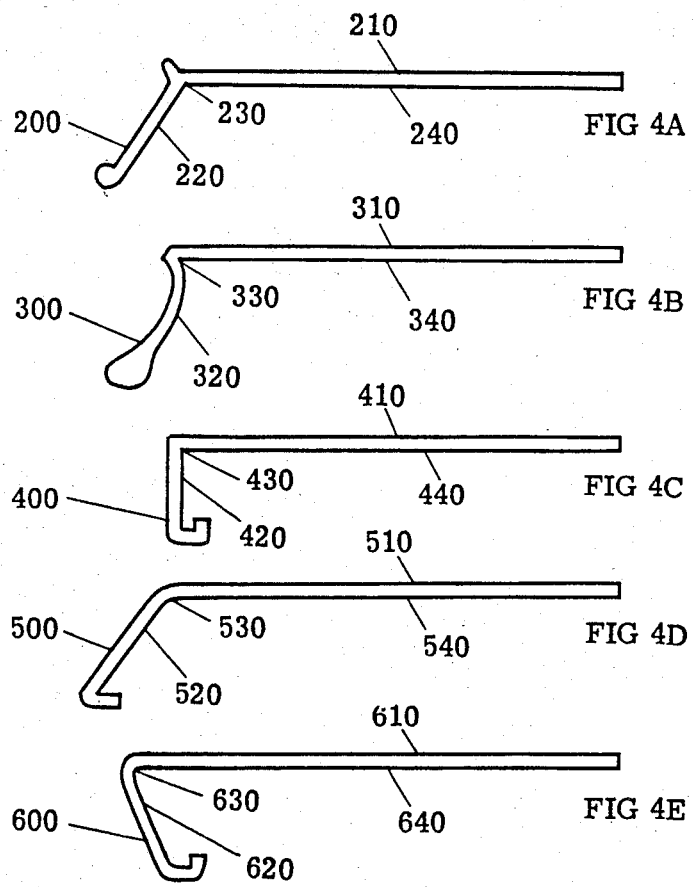

The configurations shown in FIGS. **4*a*, 4*b*, and 4D depict configurations wherein the means for concealing 200, 300, 500, respectively, protrude forwardly of the means for supporting 210, 310, 510 respectively. The configuration of means for concealing 400, FIG. 4C, is normal, i.e. at a right angle, to means for supporting 410. Means for concealing 600 projects backwardly relative to means for supporting 610, FIG. 4E**.

A means for concealing (not shown) may be readily conformed to any of the forwardly projecting, right angle, or rearwardly projecting shelf/lip configurations of FIGS. 4A–4E. Typically since means for concealing include a right angle crimp as described with reference to the embodiment of FIGS. 1–3 hereinabove. Also similar to the embodiment depicted in FIGS. 1–3, the crimp of a means for concealing used in conjunction with the configuration shown in FIGS. 4A–4E may comprise an obtuse, acute or other angle which most suitably conforms the movement of the means for concealing into and out of the non-viewable position.

In all of the shelf/lip configurations depicted in FIGS. 4A–4E, a means for readily identifying (not shown) is preferably attached to a rearward surface 220, 320, 420, 520, 620 of the means for concealing 200, 300, 400, 500, 600 but may also be readily attached to an underside surface 240, 340, 440, 540, 640, and readily conformed for parallel attachment thereto in the non-viewable position. As described with reference to structures depicted in FIGS. 1–3 hereinabove a suitable hinge effects the attachment of a means for readily identifying to a rearward surface of the means for concealing 200, 300, 400, 500, 600 (or an underside surface) such that the means for readily identifying may be moved between a viewable position and a non-viewable position whereby the means for readily identifying is attachable to an underside surface of a means for supporting in substantially parallel relationship.

The preferred method for forming a suitable crimp in a plastic means for readily identifying is forming such crimp (i.e. angle) as part of a plastic extrusion process. Other conventional means for creating such crimps, such as die pressing or attaching separate components together at a predetermined angle and the like may be employed depending on the materials employed in constructing the means for readily identifying.

It will now be apparant to those skilled in the art that other embodiments, improvements, details, and uses can be made consistent with the letter and spirit of the foregoing disclosure and within the scope of this patent, which is limited only by the following claims, construed in accordance with the patent law, including the doctrine of equivalents.

What is claimed is:

1. A concealed inventory control device for readily identifying and accounting for objects arranged in sequential front to back and side to side alignment comprising:

means for readily identifying said objects arranged in front to back and side to side alignment on a means for supporting the objects;

means for concealing the means for readily identifying, comprising a lip means extending downwardly from the forward edge of the means for supporting;

means for moving the means for readily identifying between a first viewable position and a second non-viewable position, the means for moving comprising a hinge and a means for attaching the hinge to the means for readily identifying and the means for supporting or the means for concealing, the hinge being selected from the group consisting of flexibly resilient material and pin and aperture means; and, means for holding the means for readily identifying in the second non-viewable position;

wherein the means for readily identifying comprises a lip means extending downwardly from the forward edge of the means for supporting and wherein the hinge is attached to the means for concealing in substantially parallel arrangement to the forward edge of the means for supporting.

2. The device of claim 1 wherein the means for holding is selected from the group consisting of magnetic means, resilient snap fittable means, resilient snug fittable means, adhesive means, spring means, and friction means.

3. The device of claim 2 wherein the means for readily identifying comprises a plastic strip.

4. The device of claim 1 wherein the hinge comprises the means for holding the back of the flat strip adjacent the underside of the means for supporting.

5. The device of claim 2 wherein the hinge is attached to the back of the lip, the back of the lip curving rearwardly underneath the means for supporting providing a rearward surface for attachment of the hinge whereby the means for readily identifying may be moved into the second non-viewable position substantially parallel to the means for supporting.

6. The device of claim 5 wherein the plastic strip includes a crimp conforming the plastic strip to ready movement into a substantially parallel, non-viewable position under the means for supporting.

7. The device of claim 2 wherein the hinge is attached to the back of the lip, the lip slanting below the means for supporting providing a rearward surface for attachment of the hinge whereby the means for readily identifying may be moved into the second non-viewable position substantially parallel to the means for supporting.

8. The device of claim 7 wherein the plastic strip includes a crimp conforming the plastic strip to ready movement into a substantially parallel, non-viewable position under the means for supporting.

9. The device of claim 6 wherein the crimp comprises an angle of about ninety degrees.

10. The device of claim 8 wherein the crimp comprises an angle of about ninety degrees.

* * * * *